United States Patent [19]

Nishimura

[11] Patent Number: 4,466,379

[45] Date of Patent: Aug. 21, 1984

[54] MAGNETIC BRUSH APPARATUS

[75] Inventor: Fuminobu Nishimura, Yokohama, Japan

[73] Assignee: Tokyo Shibaura Denki Kabushiki Kaisha, Kawasaki, Japan

[21] Appl. No.: 409,851

[22] Filed: Aug. 20, 1982

[30] Foreign Application Priority Data

Aug. 25, 1981 [JP] Japan ..... 56-132127

[51] Int. Cl.[3] ..... G03G 15/09

[52] U.S. Cl. ..... 118/658

[58] Field of Search ..... 118/657, 658

[56] References Cited

U.S. PATENT DOCUMENTS 3,641,969 2/1972 Hakanson ..... 118/637

*Primary Examiner*—Bernard D. Pianalto

*Attorney, Agent, or Firm*—Cushman, Darby & Cushman

[57] ABSTRACT

In a developing apparatus, a rotatable cylindrical sleeve faces to a photosensitive layer. A rotatable magnet roller is arranged inside the cylindrical sleeve and which is provided magnet poles facing the photosensitive layer. A movable scraper is pivotally supported and has a free end. The free end of the scraper allows passage of the developer which is conveyed on a surface of the cylindrical sleeve upon rotation of the magnet roller through a gap between the free end and the cylindrical sleeve when the free end is separated from the cylindrical sleeve by pivoting of the scraper. The free end scrapes off the developer when the free end contacts with the cylindrical sleeve.

2 Claims, 6 Drawing Figures

MAGNETIC BRUSH APPARATUS

BACKGROUND OF THE INVENTION

The present invention relates to a magnetic brush apparatus and, more particularly, to a magnetic brush apparatus for developing an electrostatic latent image on a photosensitive body or cleaning the photosensitive body in an electrophotographic apparatus.

Generally, in a electrophotographic copying machine, a developing apparatus with a magnetic brush is used to develop an electrostatic latent image formed on the surface of a photosensitive body. The magnetic brush contacts the photosensitive body to electrostatically transfer the positively or negatively charged developer onto the surface of the photosensitive body.

In a copying machine of this type, after the developing step as described above, the developer on the surface of the photosensitive body is transferred onto a paper sheet. A cleaning apparatus is used to remove the residual toner remaining untransferred on the surface of the photosensitive body.

A developing apparatus and a cleaning apparatus as shown in FIGS. 1 and 2, respectively, are conventionally known.

As shown in FIG. 1, in a conventional developing apparatus 2, magnetic poles 6 arranged at one side of a magnet roller 4 are set at positions to oppose a photosensitive layer 8 of a photosensitive drum. When a sleeve 10 rotates in a direction indicated by arrow M, developer 14 in the form of a brush is taken out of a casing 12 and is brought into contact with the photosensitive layer 8. The developer 14 which does not attach to the photosensitive layer 8 but remains on the sleeve 10 is returned into the casing 12 as the sleeve 10 further rotates. A fixed scraper 17 constantly contacts the surface of the sleeve 10 so as to scrape off the residual toner 14 on the sleeve 10. After developing, the magnet roller 4 is rotated through about 180° in the direction indicated by arrow M, so that the magnetic poles 6 are positioned away from an opening in the casing 12 and the rotation of the sleeve 10 is interrupted.

When the developing operation is resumed, the magnet roller 4 and the sleeve 10 are rotated in the direction indicated by arrow N, and the developer is brought in the direction from the scraper 17. However, since the scraper 17 constantly contacts the sleeve 10, the developer is scraped off. For this reason, when the rotating of sleeve 10 starts a magnetic brush of a suitable contour is not formed, so that a sufficient amount of developer is not attached to the photosensitive body 8, resulting in defective developing.

Meanwhile, in a conventional cleaning apparatus 18 shown in FIG. 2, a plurality (four in this case) of scrapers 22, 24, 26 and 28 which may be brought into direct contact with or separated from a photosensitive layer 20 of a photosensitive body are arranged so as to separately recover residual developers of respective colors from the photosensitive layer 20. These scrapers are brought into contact with the photosensitive body to clean it. However, in this conventional cleaning apparatus, since the scrapers directly contact the photosensitive layer 20, the relatively expensive photosensitive layer 20 may be abraded or damaged or formed a film of developer by rubbing of scraper. Thus the service life of the photosensitive layer is shortened.

SUMMARY OF THE INVENTION

It is an object of the present invention to provide a developing apparatus which is capable of constantly supplying a sufficient amount of a developer.

It is another object of the present invention to provide a cleaning apparatus which is capable of prolonging the service life of a photosensitive body.

According to an aspect of the present invention, there is provided an apparatus for forming a magnetic brush which contacts a photosensitive layer, comprising:

a rotatable cylindrical sleeve which is arranged close to said photosensitive layer and which is made of a nonmagnetic material;

a magnet roller which is arranged inside said cylindrical sleeve and which has magnetic poles facing said photosensitive layer through said cylindrical sleeve, lines of magnetic force generated from said magnetic poles forming the magnetic brush of a developer on said cylindrical sleeve; and a scraper which is arranged close to said cylindrical sleeve such that said scraper may be brought into contact with or separated from said cylindrical sleeve, said scraper allowing passage of the developer which is conveyed on a surface of said cylindrical sleeve upon rotation of said magnet roller through a gap between said scraper and said cylindrical sleeve when said scraper is separated from said cylindrical sleeve by said gap, and said scraper scraping off the developer which is conveyed on said cylindrical sleeve when said scraper contacts with said sleeve.

DETAILED DESCRIPTION OF THE PREFERRED EMBODIMENTS

A magnetic brush apparatus according to the present invention will now be described in detail with reference to FIGS. 3 to 6.

Figure 1:
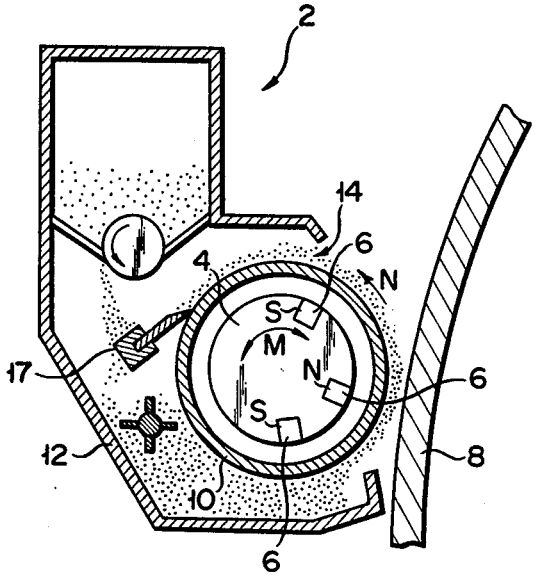
FIG. 1 PRIOR ART
FIG. 1 is a schematic sectional view of a conventional developing apparatus.
Figure 2:
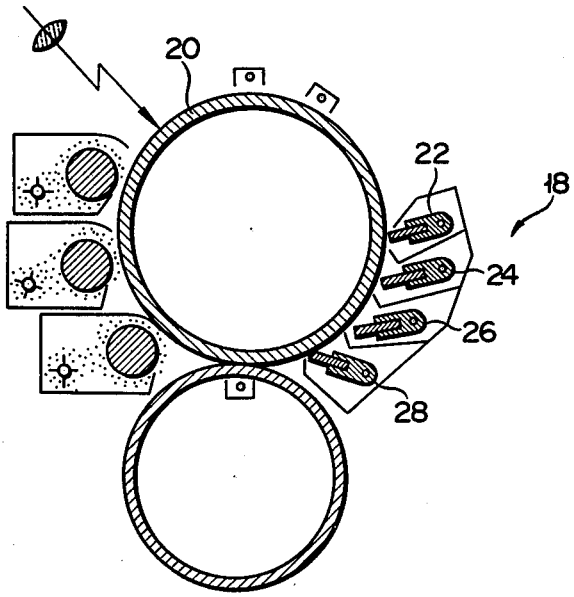
FIG. 2 PRIOR ART
FIG. 2 is a schematic sectional view of a conventional cleaning apparatus.
Figure 3:
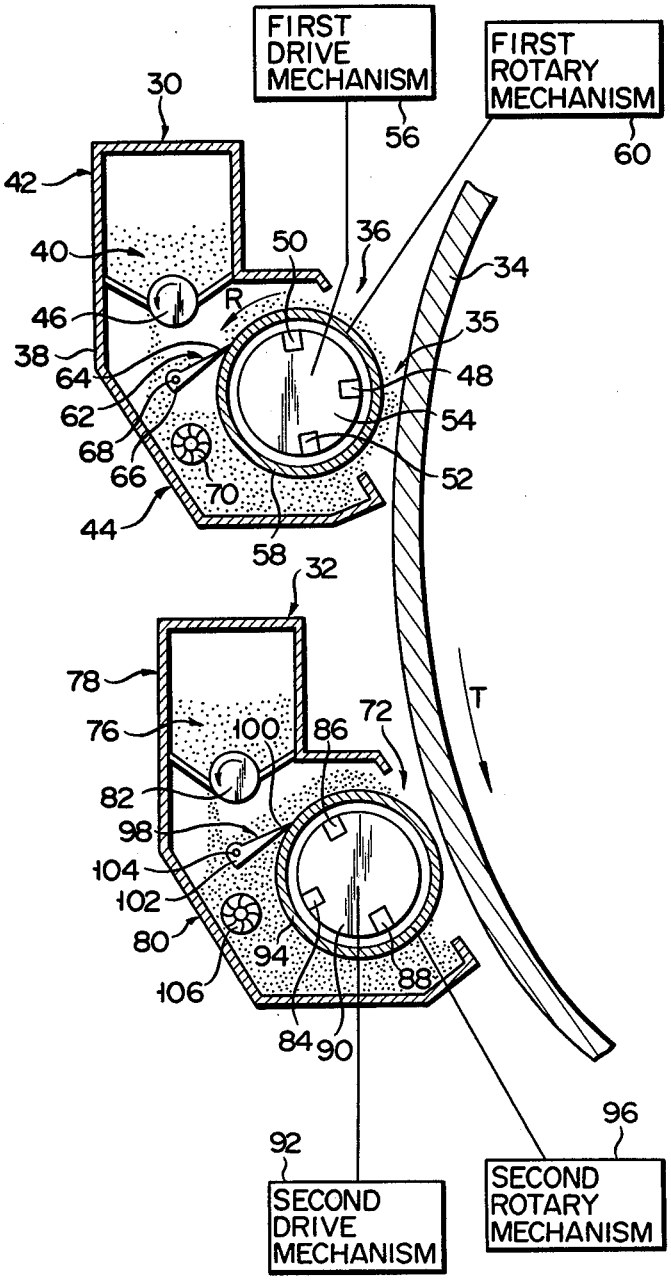
FIGS. 3 to 5 are schematic sectional views of two developing apparatuses for printing in black and red according to the first embodiment of the present invention.

FIG. 3 shows a red developing apparatus 30 and a black developing apparatus 32 for printing in black and red. The red developing apparatus 30 has a first casing 38 including a first opening 36 formed at a position to face a photosensitive layer 34 of a photosensitive drum (not shown) rotatable in the direction indicated by arrow T. Inside the first casing 38, a first hopper 42 for supplying red toner 40 is arranged above a first chamber 44 having the first opening 36. A first roller 46 is arranged for the first hopper 42 so as to drop a predetermined amount of the red toner 40 into the first chamber. Thus, the red toner 40 is rendered loose and is supplied to the first chamber 44. The first chamber 44 has a first magnet roller 54 which has, at the side of the first opening 36, a first main pole 48 and first convey poles 50 and 52 sandwiching the first main pole 48, and which is rotatable in the clockwise and counterclockwise directions. The first magnet roller 54 is coupled to a first drive mechanism 56 which rotates it through about 180° in the clockwise and counterclockwise directions. The first magnet roller 54 is coaxially arranged inside a first sleeve 58 with a predetermined distance therebetween. The first sleeve 58 is made of a nonmagnetic material and spaced from the photosensitive layer 34 by a predetermined distance. The first sleeve 58 is coupled to a first rotary mechanism 60 for selectively rotating it in the clockwise or counterclockwise direction. Inside the first chamber 44 a first scraper 62 is arranged at the side opposite to the first opening 36 and scrapes off the red toner 40 attached on the first sleeve 58. One end of the first scraper 62 is flatly pointed, and the other end 66 of the first scraper 62 is supported pivotally about a first pin 68. The scraper 62 is pivoted by the flow resistance of the red toner, and one end 64 is brought into contact or separated from the first sleeve 58. Agitating blades 70 for constantly and uniformly agitating the red toner 40 are further arranged inside the first casing 38.

The black developing apparatus 32 is arranged downstream of the photosensitive layer 34 along the rotating direction indicated by arrow T. The black developing apparatus 32 has the same structure as that of the red developing apparatus 30. More specifically, the black developing apparatus 32 has a second casing 74 with a second opening 72 formed at a position to oppose the photosensitive layer 34. Inside the second casing 74, a second hopper 78 for supplying black toner 76 is arranged above a second chamber 80. A second roller 82 which is rotatable to drop a predetermined amount of the black toner 76 into the second chamber 80 is arranged for the second hopper 78. In this manner, the black toner 76 is rendered loose and is supplied to the second chamber 80. The second chamber 80 has a second magnet roller 90 which has a second main pole 84 at the opposite side from the second opening 72 and second convey poles 86 and 88 sandwiching the main pole 84, and which is rotatable in the clockwise and counterclockwise directions. The second magnet roller 90 is coupled to a second drive mechanism 92 for driving it through about 180° in the clockwise or counterclockwise direction. The second magnet roller 90 is arranged coaxially within the second sleeve 94 with a predetermined distance therebetween. The second sleeve 94 is made of a nonmagnetic material and is rotatable. The second sleeve 94 is separated from the photosensitive layer 34 by a predetermined distance, and is coupled to a second rotary mechanism 96 for selectively rotating it in the clockwise or counterclockwise direction. Inside the second chamber 80 is arranged a second scraper 98 which is arranged at the opposite side from the second opening 72 and which scrapes off the black toner 76 attached on the surface of the second sleeve 94. One end 100 of the second scraper 98 has a tapered edge shape, and the other end 102 of the second scraper 98 is suported pivotally about a second pin 104. The second scraper 98 is pivoted by the flow resistance of the black toner, and one end 100 is brought into contact with or separated from the second sleeve 94. Second agitating blades 106 for constantly and uniformly agitating the black toner 76 are arranged inside the second casing 74.

The mode of operation of the developing apparatuses according to the first embodiment of the present invention will now be described with reference to FIGS. 3 to 6.

As shown in FIG. 3, the photosensitive layer 34 is rotated in the direction indicated by arrow T, and red developing is first performed. More specifically, the region of the photosensitive layer 34 which is to be developed in red reaches a red developing region 35 including the first opening 36 by rotation of the photosensitive drum (not shown). In the red developing region 35, the first main pole 48 of the first magnet roller 54 faces the photosensitive layer 34, and the first sleeve 58 rotates in the direction indicated by arrow R. Therefore, the red toner which is in the form of a magnetic brush and is conveyed onto the first sleeve 58 is brought into contact with the photosensitive layer 34. As a result, the red toner is electrostatically attracted to the electrostatic latent image formed on the surface of the photosensitive layer 34, so that the electrostatic latent image on the photosensitive layer 34 is developed with the red toner 40. The magnetic brush is conveyed in the manner to be described below. The charged red toner forms a magnetic brush on the first sleeve 58 in the vicinity of the first convey pole 52. The magnetic brush is then conveyed to the first opening 36 as the first sleeve 58 rotates.

The magnetic brush formed on the first sleeve 58 is drawn inside the first casing 38 through the red developing region 35 of the first opening 36. The flow of the red toner 40 urges the first scraper 62 so that the one end 64 thereof is brought into sliding contact with the surface of the first sleeve 58. The magnetic brush formed on the surface of the first sleeve 58 is separated from the first sleeve 58 by the first scraper 62.

During developing in red, the second main pole 84 is positioned inside the second casing, and the second sleeve 94 in the black developing apparatus is at rest.

Figure 4:
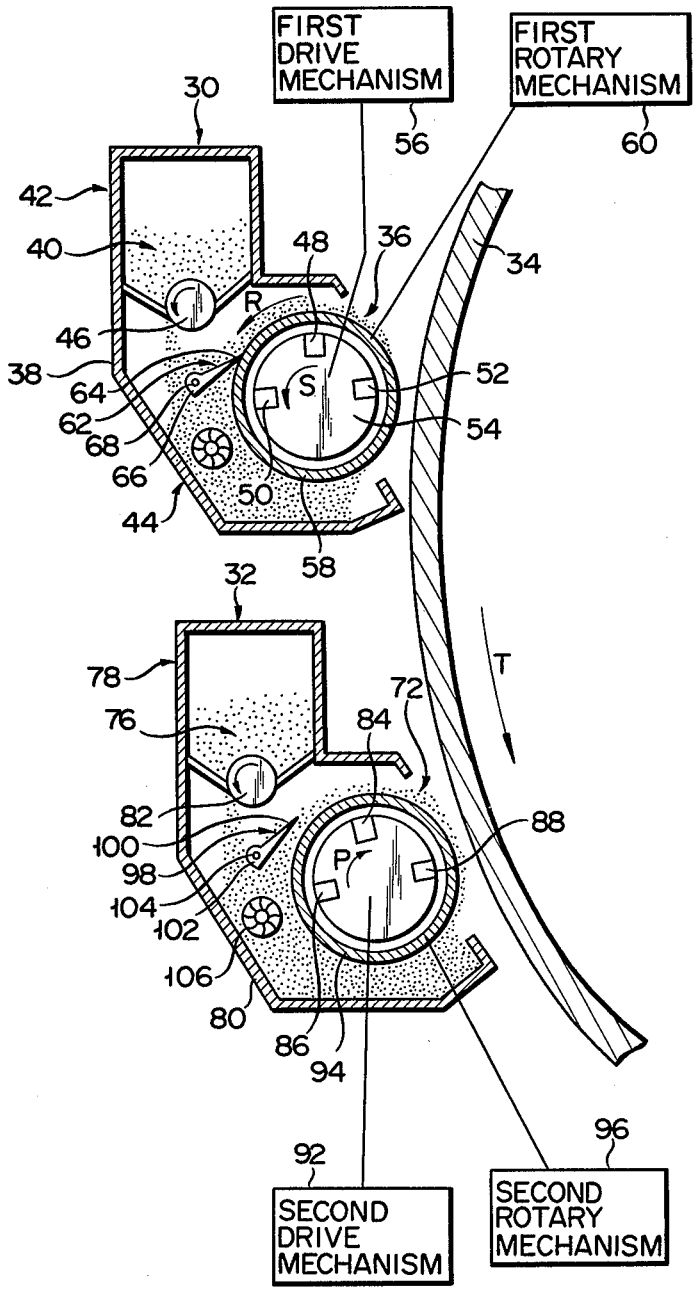

When developing in red is completed, the main pole 48 of the first magnet roller 54 of the red developing apparatus 30 is rotated by the first drive mechanism 56 from the position opposing the photosensitive layer 34 as shown in FIG. 3 to the position as shown in FIG. 4 through about 180° in the direction indicated by arrow S. The first sleeve 58 continues to rotate in the direction indicated by arrow R. Therefore, the magnetic brush is transferred inside the first casing 38.

Meanwhile, the second magnet roller 90 of the black developing apparatus 32 is rotated in the direction indicated by arrow P by the second drive mechanism 92. The second sleeve 94 is at rest.

Figure 5:
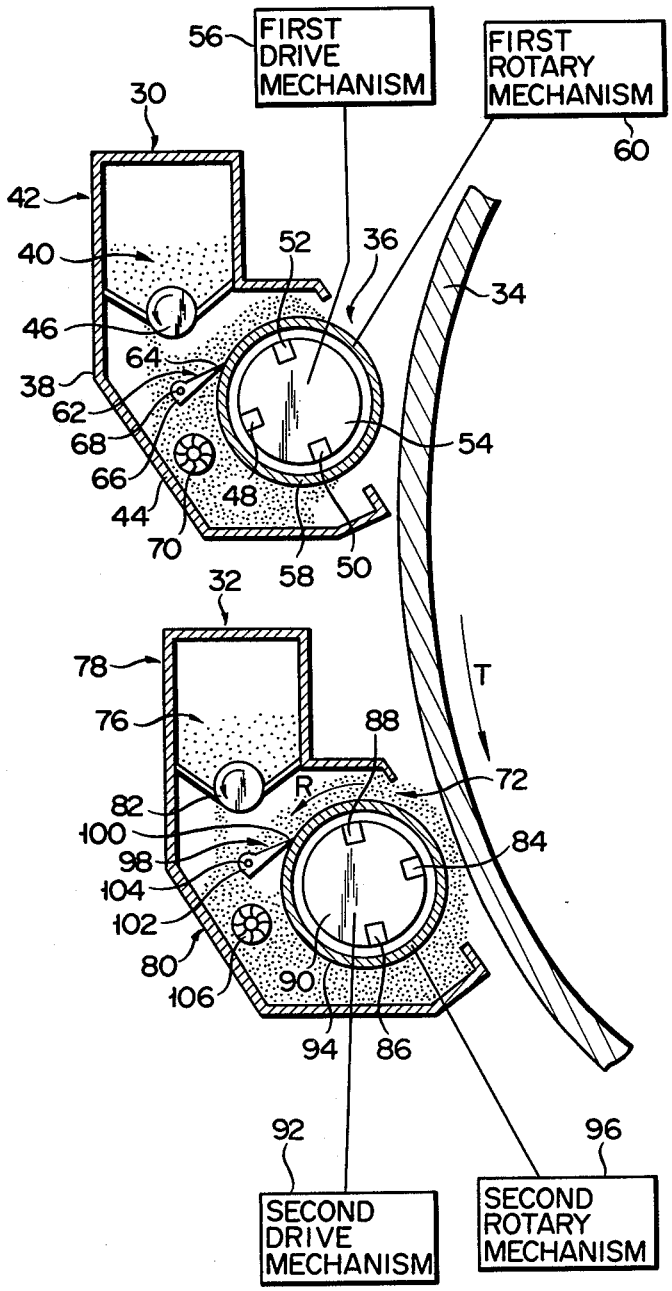

As shown in FIG. 5, when the first main pole 48 of the first magnet roller 54 of the red developing apparatus 30 is positioned at the opposite side from the first opening 36 and the first convey poles 50 and 52 are positioned inside the casing, rotation of the first magnet roller 54 and the first sleeve 58 is interrupted. Then, the magnetic brush is completely housed inside the casing, and developing in red is interrupted.

The second main pole 84 of the black developing apparatus 32 reaches the second opening 72 to oppose the photosensitive layer 34, and the second convey poles 86 and 88 come to rest inside the second chamber 80, as shown in FIG. 5. At this time, the second sleeve 94 starts rotating in the direction indicated by arrow R. Then, the magnetic brush consisting of the black toner 76 is taken out of the second casing 74 to the second opening 72 to start developing in black. Since the mode of operation for developing in black is the same as that for developing in red shown in FIG. 3, a description thereof will be omitted.

According to the first embodiment described above, during a transition from a non-developing to a developing operation, the magnetic brushes formed on the first and second sleeves 58 and 94, respectively, are smoothly transferred to the first and second openings 36 and 72, respectively, without being scraped off by the first and second scrapers 62 and 98. Therefore, a sufficient amount of toner may be constantly supplied to the photosensitive layer from the beginning to the end of the developing operation and attached to the photosensitive layer appropriately.

The second embodiment of the present invention will now be described in more detail with reference to FIG. 6.

Figure 6:
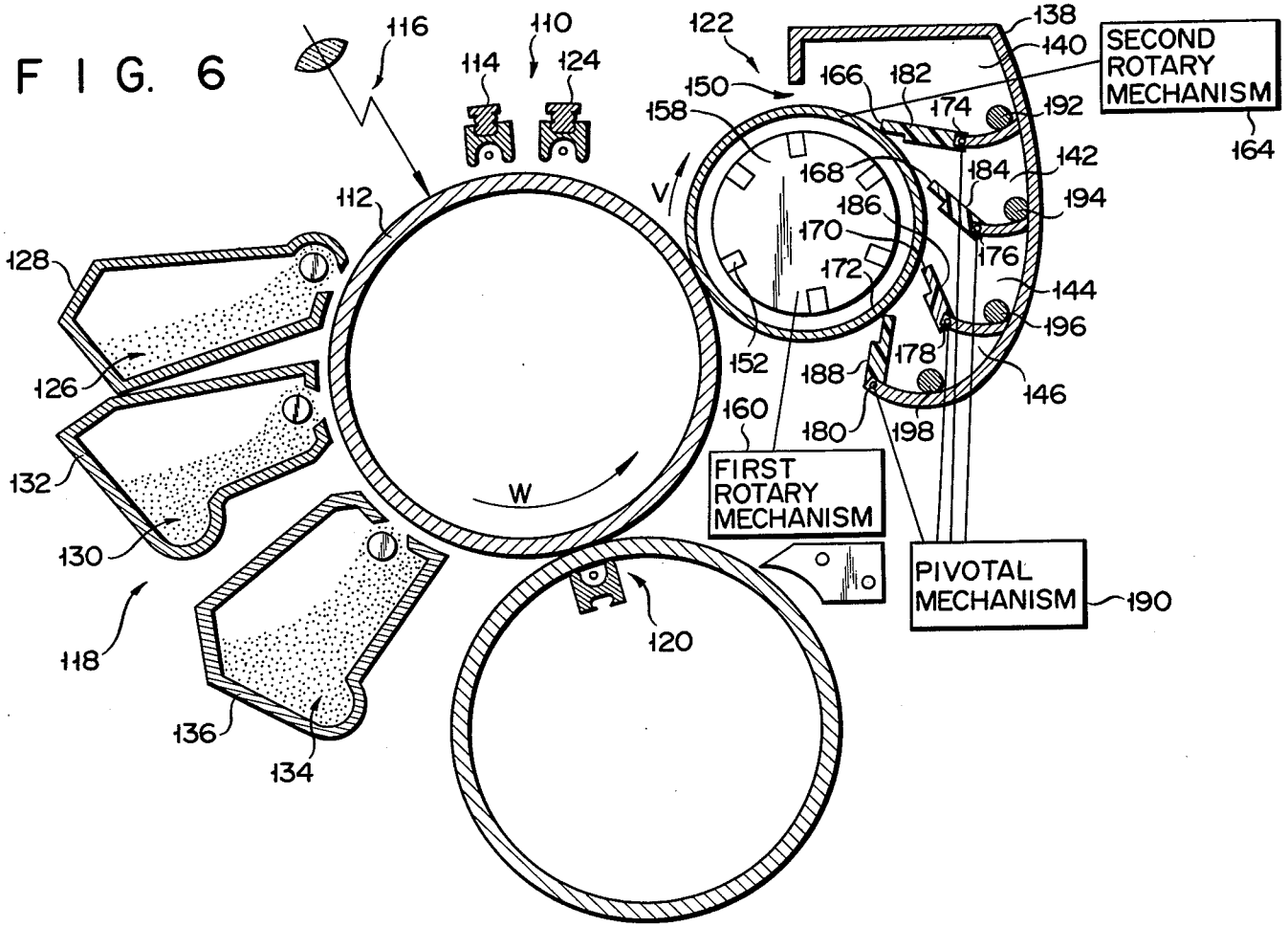
FIG. 6 is a schematic view of a copying machine with a cleaning apparatus according to the second embodiment of the present invention.

FIG. 6 shows a copying machine 110 for color copying. The copying machine 110 has a cylindrical photosensitive layer 112 around which are arranged a charging apparatus 114, an exposure apparatus 116, a developing apparatus 118, a transfer apparatus 120, a cleaning apparatus 122 and a discharging apparatus 124.

The cleaning apparatus 122 has a magnetic brush apparatus according to the second embodiment of the present invention. The developing apparatus 118 has a first developing apparatus 128 for supplying yellow toner 126, a second developing apparatus 132 for supplying magenta toner 130, and a third developing apparatus 136 for supplying cyan toner 134.

Inside a casing 138 of the cleaning apparatus 122 are defined a first chamber 140 for storing the yellow toner 126, a second chamber 142 for storing the magenta toner, a third chamber 144 for storing the cyan toner 134, and a fourth chamber 146 for storing a mixture 148 of these toners. The casing 138 has an opening 150 common to the respective chambers. A magnet roller 158 having a number of convey poles 152 on the surface thereof is rotatably arranged at the side of the opening 150. The magnet roller 158 is coupled to a first rotary mechanism 160 in order to rotate. The magnet roller 158 is coaxially arranged inside a sleeve 162 with a predetermined distance therebetween. The sleeve 162 is made of a nonmagnetic material and is rotatable; it is coupled to a second rotary mechanism 164 for rotating the sleeve 162 around the magnet roller 158.

First through fourth scrapers 182, 184, 186 and 188 are arranged at the bottom surfaces defining the first through fourth chambers 140, 142, 144 and 146, respectively, such that one end 166, 168, 170 or 172 of each thereof may be brought into contact with the sleeve 162 or separated therefrom and the other end 174, 176, 178 or 180 of each thereof is pivotal. The other ends 174, 176, 178 and 180 of these scrapers are coupled to a pivotal mechanism 190 which is capable of individually pivoting them. Reference symbols 192, 194, 196 and 198 denote recovery apparatuses which convey the recovered toners into the respective chambers and to ends thereof.

The mode of operation of the cleaning apparatus according to the second embodiment of the present invention will now be described.

When the copying operation is started, the photosensitive layer 112 is rotated in the direction indicated by arrow W. An electrostatic latent image corresponding to the yellow portion of a manuscript (not shown) is formed on the photosensitive layer 112, and the magnetic yellow toner is attached thereto from the first developing apparatus 128. After the yellow toner is transferred onto the paper sheet (not shown), that part of the photosensitive layer 112 to which the yellow toner has been transferred reaches the cleaning apparatus 122.

Then, the sleeve 162 is rotated in the direction indicated by arrow V in contact with the photosensitive layer 112 as the photosensitive layer 112 is rotated. The yellow toner remaining on the photosensitive layer 112 becomes attached to the surface of the sleeve by the magnetic attraction force of magnet roller 158 which is rotating. The yellow toner attached on the surface of the sleeve forms a magnetic brush and is conveyed in the direction indicated by arrow V to reach the casing 138.

When the yellow toner reaches the casing 138, the first scraper 182 for recovering only the yellow toner and the fourth scraper 188 for recovering the mixture of toners are pivoted by the pivotal mechanism 90. One end 166 of the first scraper 182 and one end 172 of the fourth scraper 188 are urged against the sleeve. As a result, the yellow toner on the surface of the sleeve is scraped off by the first scraper 182 and is recovered into the first chamber. The yellow toner further remaining on the sleeve is scraped off by the fourth scraper 188 to be recovered into the fourth chamber 146.

In a similar manner, the magenta toner supplied from the second developing apparatus is selectively scraped off by the second scraper 184 and the fourth scraper 188 and is respectively recovered into the second chamber 142 and the fourth chamber 146. The cyan toner 134 supplied from the third developing apparatus 136 is scraped off by the third scraper 186 and the fourth scraper 188 and is recovered into the third and fourth chambers 144 and 146.

According to the second embodiment, since the scrapers do not directly scrape off the residual toner on the photosensitive layer, the relatively expensive photosensitive layer may not be damaged or abraded. Therefore, the service life of the photosensitive layer is prolonged.

According to the second embodiment, the toners as developers are recovered for respective colors and may be reused, so that a copying machine of low operating cost may be obtained.

According to the second embodiment described above, the residual toner on the surface of the photosensitive layer may be effectively and easily attracted to the side of the sleeve by the magnetic attraction force of the convey poles.

The present invention is not limited to the particular embodiments described above and various modifications may be made.

For example, the colors of developers to be used need not be limited to two, and the actual colors such as yellow or green and the number of colors of the developers may be freely selected.

In the first embodiment, if the distance between the scraper and the sleeve is set to equal the distance between the photosensitive layer and the sleeve, it will serve as a doctor blade for regulating the thickness of the developer layer. With this arrangement, an extra amount of the developer may not be supplied from the developing apparatus at the beginning of the developing operation, so that the developer will not leak to the outside.

In the second embodiment, a description is given with reference to developers of three colors. However, the present invention is not limited to this structure. The actual colors and the number of colors may be freely selected to obtain the same effects. In this case, the number of chambers for recovering the developer may equal that of the colors of the developers or the number obtained by adding one thereto.

In summary, in the developing apparatus of the present invention, since defective conveyance of the developer is avoided at the beginning of the developing, defective developing may be avoided. In the cleaning apparatus of the present invention, since the scrapers do not directly contact the photosensitive body, the photosensitive body may not be damaged. Therefore, the service life of the photosensitive body may be prolonged.

What is claimed is:

1. An apparatus for forming a magnetic brush which contacts a photosensitive layer, comprising:

a rotatable cylindrical sleeve which is arranged close to the photosensitive layer and which is made of a non-magnetic material;

a magnet roller arranged inside the cylindrical sleeve and having on one side thereof at least one pair of magnetic poles, said magnet roller being reversibly rotatable between a first position in which the pair of magnetic poles faces said photosensitive layer through the cylindrical sleeve and second position in which the pair of magnetic poles is separated from said photosensitive layer, said magnet roller generating a magnetic field which acts on a developer on said cylindrical sleeve to form the magnetic brush;

a driving mechanism for reversibly rotating said magnet roller between the first position and the second position; and a scraper having a proximal end portion which is freely pivotally supported and free end which is movable from the cylindrical sleeve, said free end allowing passage of the developer, which is conveyed on a surface of said cylindrical sleeve upon moving of said magnetic poles from the second position to the first position, through a gap between said free end and said cylindrical sleeve when said scraper is separated from said cylindrical sleeve by the force of the moving developer, and said free end scraping off the developer, which is conveyed on said cylindrical sleeve upon the reverse moving of said magnetic poles from the first position to the second position, since said free end contacts said sleeve.

2. An apparatus according to claim 1, wherein said apparatus comprises a developing apparatus, and said sleeve has a first rotary mechanism which rotates said sleeve in one rotating direction so as to oppose said scraper with said magnetic brush formed on said sleeve when said scraper is brought into contact with said sleeve during a developing operation, and which stops said sleeve at a beginning of the developing operation wherein a transition is made from a non-developing operation to the developing operation.

* * * * *